US008764446B2

(12) United States Patent
Landies et al.

(10) Patent No.: US 8,764,446 B2
(45) Date of Patent: Jul. 1, 2014

(54) M249 NON-FIREARM SIMULATING A FUNCTIONAL M249 FIREARM

(76) Inventors: Robert I. Landies, Chardon, OH (US); Daniel L. Albright, Chardon, OH (US); Joshua G. Hershberger, Concord Township, OH (US); Brian E. Johnson, Chardon, OH (US)

( * ) Notice: Subject to any disclaimer, the term of this patent is extended or adjusted under 35 U.S.C. 154(b) by 74 days.

(21) Appl. No.: 13/155,683

(22) Filed: Jun. 8, 2011

(65) Prior Publication Data

US 2011/0306019 A1 Dec. 15, 2011

Related U.S. Application Data

(60) Provisional application No. 61/352,850, filed on Jun. 9, 2010.

(51) Int. Cl.
*G09B 19/00* (2006.01)

(52) U.S. Cl.
USPC ..... 434/16; 434/11

(58) Field of Classification Search
USPC ..... 434/11–28; 42/70.01–70.11
See application file for complete search history.

(56) References Cited

U.S. PATENT DOCUMENTS 7,581,954 B2 * 9/2009 Schavone ..... 434/18
2007/0190495 A1 * 8/2007 Kendir et al. ..... 434/21

* cited by examiner

*Primary Examiner* — Timothy A Musselman
(74) *Attorney, Agent, or Firm* — Renner Kenner Greive Bobak Taylor & Weber

(57) ABSTRACT

A non-firing housing imitates a functioning receiver for an M249 machine gun. The non-firing housing includes one or more of a number of alterations as compared to a functioning M249 receiver. Such alterations include: providing a non-firing barrel support with substantial dimensional differences as compared to a standard M249 barrel support; providing a non-firing barrel support with additional structural features that prevent any bolt head (and particularly a standard M249 bolt head) from entering the battery position; providing right or left non-firing bolt rails with dimensional or structural or positional alterations as compared to standard right and left bolt rails for a standard M249; providing the non-firing housing with the absence of an ejection port; providing a non-firing right bolt rail with the absence of a hinge bore; and providing a non-firing left bolt rail with the absence of an ejector pin bore and back stop material.

15 Claims, 6 Drawing Sheets

M249 NON-FIREARM SIMULATING A FUNCTIONAL M249 FIREARM

PRIORITY

This application claims priority from U.S. provisional patent application Ser. No. 61/352,850 filed on Jun. 9, 2010, which is incorporated herein by reference in its entirety.

FIELD OF THE INVENTION

This invention relates to a non-firing M249 machine gun that imitates a functioning M249 machine gun. In particular embodiments, the non-firing M249 machine gun simulates the cycling of a functional M249 machine gun, though no ammunition is fired.

BACKGROUND OF THE INVENTION

In the United States, firearms capable of fully automatic fire may only be legally taken into possession by qualified, law-abiding individuals or organizations that apply for and obtain the requisite permission from the local authorities and the Bureau of Alcohol Tobacco Firearms and Explosives (BATFE). In the United States, the process that must be followed to legally obtain a fully automatic machine gun can take over 12 months to complete. Forms must be filled, mailed, received, reviewed, and filed, and fingerprints must be taken and background checks performed by law enforcement officers and the BATFE. Processes can vary from state to state, county to county and city to city, making it very difficult for machine gun dealers to efficiently handle machine gun supplies to meet machine gun demands, particularly because the dealer takes possession of the purchased firearm during the waiting period and must properly store it, also in accordance with a great number of laws and regulations. The process is likely similar in other countries that permit the purchase of such weapons.

There are many individuals and organizations that purchase machine guns and yet do not actually need a functioning machine gun for the purpose for which it was purchased. For example, dealers in machine gun mounts need only an imitation of a machine gun having those features necessary to mount the imitation in an intended mount in order to show that the mount would be functional for the corresponding functional machine gun the imitation is to simulate. Yet, because it is desirable to show potential customers a very accurate representation of the interaction between the machine gun and the mount, mount dealers often purchase functioning machine guns, despite the significant paperwork and waiting periods associated with the processing of the paperwork. When a functioning machine gun is used, the mount dealer must also follow all laws and regulations respecting the storage, transport and exhibition of machine guns. However, it is only necessary to use a functioning machine gun as part of a mount display if the entity to which the mount is being shown desires to view how the mount functions during the firing of the machine gun or otherwise wishes to see an actual functioning machine gun in the mount. Otherwise, a non-firing imitation could be used, though it would have to have the features necessary for proper mounting to the intended mount. Thus, there is a need in the art for a means for providing a non-firing imitation gun that imitates a functioning machine gun.

Other entities, for purposes of teaching and training, may desire non-firing imitation guns that, though they are non-firing, simulate one or more of the steps of cocking, firing and cycling of the functioning machine gun that they are intended to imitate. For instance, for military classroom purposes, it might be desired to have in the classroom a non-firing imitation gun that externally looks substantially identical to the functioning machine gun that it imitates, but yet does not provide all of the firing components necessary to permit the non-firing imitation gun to cycle as intended to fire rounds. Thus there is a need in the art for a non-firing imitation gun that still permits some amount of replication of the cycling of the machine gun it is intended to imitate.

The receiver portion of the machine gun typically houses the components that cause the machine gun to be characterized as a machine gun and thus be subject to the aforementioned laws and regulations. Although receivers often differ from one model of machine gun to the next, the art would benefit from concepts for manufacturing a non-firing housing, wherein the manufacturing concepts can be applied to a multitude of different types of receivers associated with different types of machine guns. Because a non-firing housing is not subject to the same laws and regulations respecting functioning receivers, any entity that desires a non-firing imitation gun that imitates a functioning machine gun could benefit from the provision of such non-firing housings.

Notably, merely altering a receiver so that it does not function as a functioning receiver is not necessarily sufficient to avoid the application of laws and regulations respecting the ownership, storage, transport and exhibition of machine guns. Particularly, in the United States, if a receiver has been modified such that it fails to function as a machine gun receiver, it would still be subject to laws and regulations regarding machine guns. According to the BATFE, once a machine gun has been manufactured and registered, it will always be considered a machine gun, no matter its state of non-functionality. The only exception is if a destruction notice is filed and evidence has been submitted to establish the complete destruction of the machine gun. Additionally, even if a receiver is initially manufactured to prohibit functioning as a machine gun, it will still be subject to all laws and regulations respecting machine guns if it is capable of being readily converted back to a functioning machine gun receiver. Thus, though there is a need in the art for non-firing housings that imitate functioning receivers of machine guns, the art would further benefit from such non-firing housings being manufactured such that the conversion of the non-firing housing into a functioning receiver is significantly frustrated.

SUMMARY OF THE INVENTION

In general, the present invention provides a non-firing M249 housing imitating a functioning receiver for an M249 machine gun. As compared to standard M249 machine gun components, the non-firing housing has components that are modified in a number of ways. However, not all of the various modifications must be practiced to implement the present invention. Thus, in various embodiments, the non-firing M249 housing includes one or more of the following alterations as compared to a standard M249:

(1) A new barrel support made with substantial dimensional differences that would limit the range of motion of a standard M249 operating rod if an attempt was made to install a standard operation rod;

(2) A new barrel support with an additional feature that prevents any bolt head (and particularly a standard M249 bolt head) from entering the battery position;

(3) A shortened overall right bolt rail length that will not mate correctly with the standard M249 barrel support, though in particular embodiments it will mate correctly with a barrel support as in (1) and/or (2) above;

(4) New bolt rails with increased width such that the non-firing housing will not accept a standard M249 bolt head and bolt carrier, i.e., a standard M249 bolt head and bolt carrier will not fit or operate in the non-firearm;

(5) A new vertical positioning of the right bolt rail (as compared to the standard positioning of the same in a standard M249) serving to inhibit the adaptation of a bolt head and bolt carrier to fit the non-firearm;

(6) The absence of an ejection port in the non-firing M249 housing;

(7) The absence of a hinge bore on the right bolt rail that, in the standard M249 is provided for receipt of the hinge for an ejection port cover; and (8) The absence of an ejector pin bore and back stop material associated with the left bolt rail, serving to prohibit installation of an ejector.

It should be noted that the non-firing M249 housing herein imitates the receiver of a standard M249, but the term "receiver" has been avoided, as that term has particular meaning in the relevant industry, and it is the intent herein to stress that the non-firing M249 housing is not a functioning receiver.

In one or more embodiments, this invention provides a non-firing housing imitating a functioning receiver for an M249 machine gun, the non-firing housing including a non-firing housing body and a non-firing barrel support secured to the non-firing housing body, the non-firing barrel support being dimensioned differently from the standard M249 barrel support so as to prevent a standard M249 bolt head from entering the battery position. In accordance with some embodiments, the non-firing barrel support is dimensioned differently by having a bolt-blocking wall that prevents a standard M249 bolt head from entering the battery position. In other embodiments, the non-firing barrel support has an extended axial length that is greater than the axial length of a standard M249 barrel support such that the non-firing housing prohibits the receipt and proper reciprocation of a standard M249 op-rod.

In one or more other embodiments, this invention provides a non-firing housing imitating a functioning receiver for an M249 machine gun, the non-firing housing including a non-firing housing body and a non-firing bolt rail selected from a non-firing right bolt rail and a non-firing left bolt rail. The non-firing bolt rail is secured to the non-firing housing body and includes a horizontal extension that, in the case where the non-firing bolt rail is selected to be a non-firing right bolt rail, extends further into the non-firing housing body than does the horizontal extension of a standard M249 right bolt rail relative to a standard M249 housing body, and, in the case where the non-firing bolt rail is selected to be a non-firing left bolt rail, extends further into the non-firing housing body than does the horizontal extension of a standard M249 left bolt rail relative to a standard M249 housing body.

In one or more other embodiments, this invention provides a non-firing housing imitating a functioning receiver for an M249 machine gun, the non-firing housing including a non-firing housing body and a non-firing right bolt rail secured to the non-firing housing body, wherein the non-firing right bolt rail includes a horizontal extension that extends at a higher position relative to the non-firing housing body than does the horizontal extension of a standard M249 right bolt rail relative to a standard M249 housing body.

In one or more other embodiments, this invention provides a non-firing housing imitating a functioning receiver for an M249 machine gun, the non-firing housing including a non-firing housing body that mimics the appearance of a standard M249 machine gun and is devoid of an ejection port, the existence of which is necessary in a standard M249 machine gun.

In one or more other embodiments, this invention provides a non-firing housing imitating a functioning receiver for an M249 machine gun, the non-firing housing including a non-firing housing body and a non-firing right bolt rail that is devoid of a hinge bore, the existence of which is necessary in a standard M249 machine gun in order to receive a hinge for an ejection port cover.

In one or more other embodiments, this invention provides a non-firing housing imitating a functioning receiver for an M249 machine gun, the non-firing housing including a non-firing left bolt rail that is devoid of an ejector pin bore and devoid of backstop material, both of which are existent in a standard M249 machine gun for the installation of an ejector, such that the absence thereof in the non-firing housing prohibits the installation of an ejector.

In one or more other embodiments, this invention provides a non-firing housing imitating a functioning receiver for an M249 machine gun, the non-firing housing including a non-firing housing body that mimics the appearance of a standard M249 machine gun and is devoid of an ejection port, the existence of which is necessary in a standard M249 machine gun; a non-firing barrel support secured to the non-firing housing body, the non-firing barrel support being dimensioned differently from the standard M249 barrel support so as to prevent a standard M249 bolt head from entering the battery position; a non-firing right bolt rail secured to the non-firing housing body, wherein the non-firing right bolt rail includes a horizontal extension that extends at a higher position relative to the non-firing housing body than does the horizontal extension of a standard M249 right bolt rail relative to a standard M249 housing body, the non-firing right bolt rail being devoid of a hinge bore, the existence of which is necessary in a standard M249 machine gun in order to receive the hinge for an ejection port cover; and a non-firing left bolt rail that is devoid of an ejector pin bore and devoid of backstop material, both of which are existent in a standard M249 machine gun for the installation of an ejector, such that the absence thereof in the non-firing housing prohibits the installation of an ejector, wherein at least one of the non-firing right bolt rail and the non-firing left bolt rail includes a horizontal extension that extends further into the non-firing housing body than does the horizontal extension of a standard M249 right bolt rail or standard M249 left bolt rail relative to a standard M249 housing body.

Figure 9:
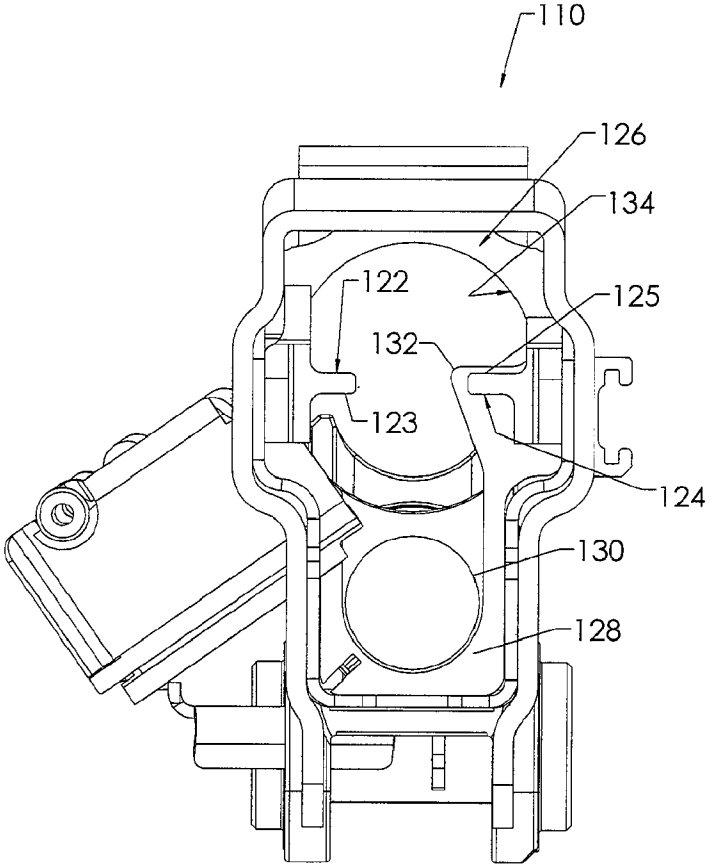
Figure 8:
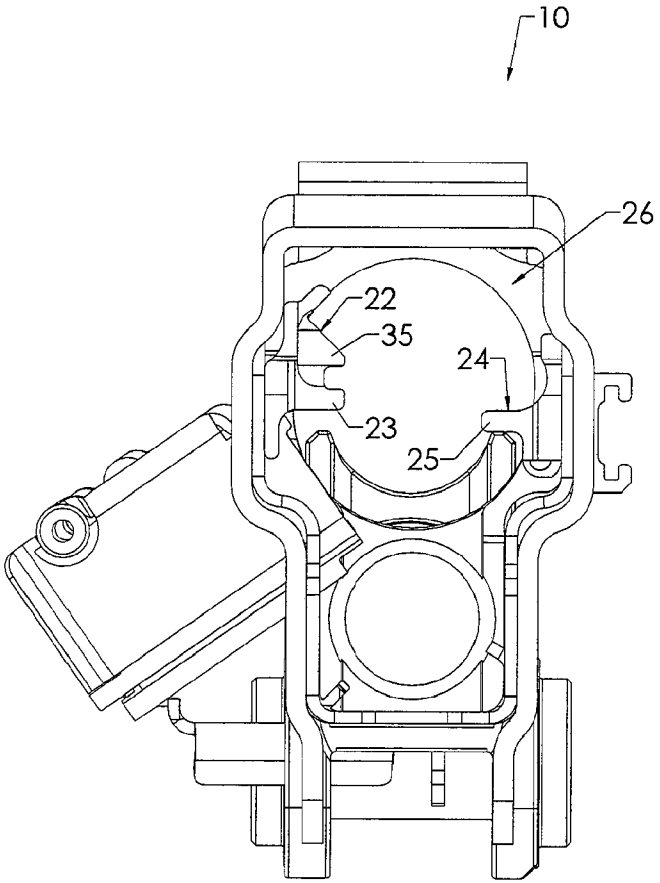
PRIOR ART FIG. 8
Figure 10:
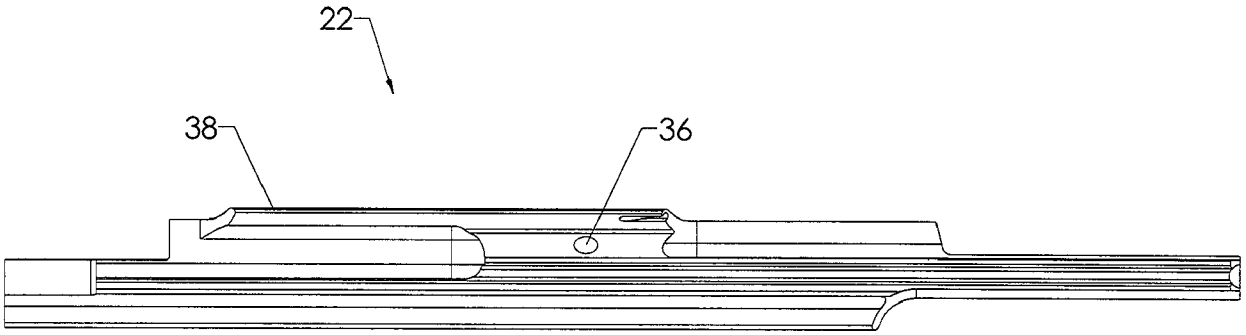
PRIOR ART FIG. 10
Figure 11:
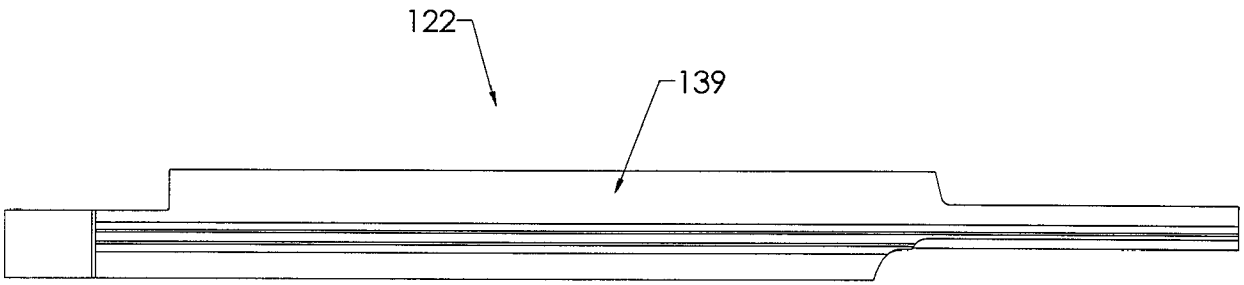

M249 of this invention;

FIG. 8 is a rear elevation view of a standard M249 receiver and shows the standard M249 receiver, left bolt rail, right bolt rail and barrel support;

FIG. 9 is a rear elevation view of a non-firing M249 housing in accordance with this invention, and shows an altered shell, left bolt rail, right bolt rail and barrel support;

FIG. 10 is a top plan view of a standard M249 left bolt rail, showing the ejector pin bore;

FIG. 11 is a top plan view of a left bolt rail for a non-firing M249 in accordance with this invention.

Figure 12:
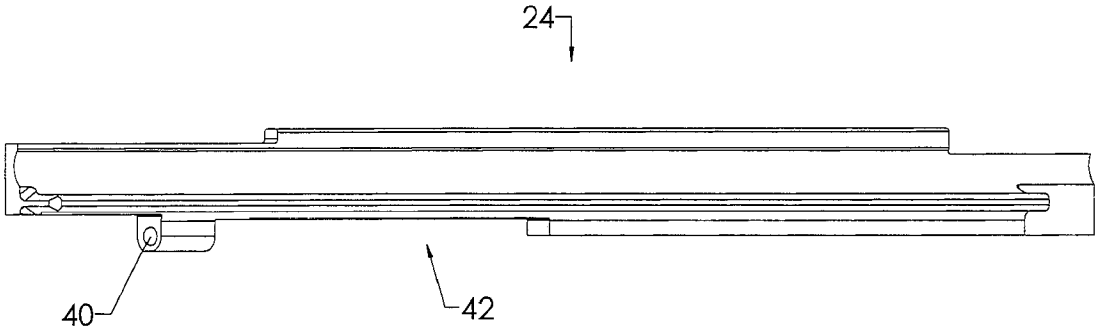
PRIOR ART FIG. 12
Figure 13:
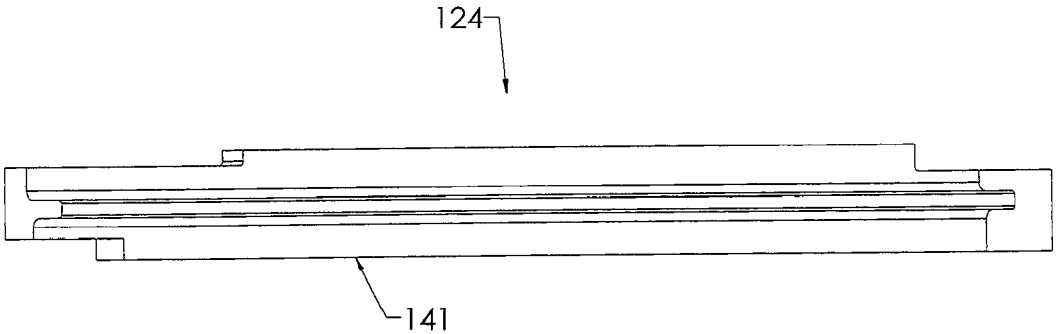
Figure 14:
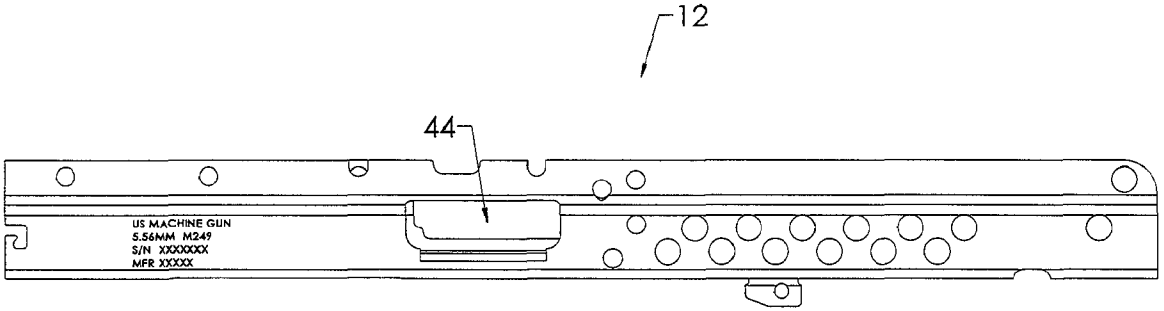
PRIOR ART FIG. 14

FIG. 12 is a side elevational view of a standard M249 right bolt rail, showing the hinge bore for the standard ejection port cover and the absence of bolt rail material proximate thereto;

FIG. 13 is a side elevational view of a right bolt rail for a non-firing M249 in accordance with this invention for comparison with the standard M249 right bolt rail of FIG. 12;

FIG. 14 is a side elevational view of a standard M249 receiver body; and

Figure 15:
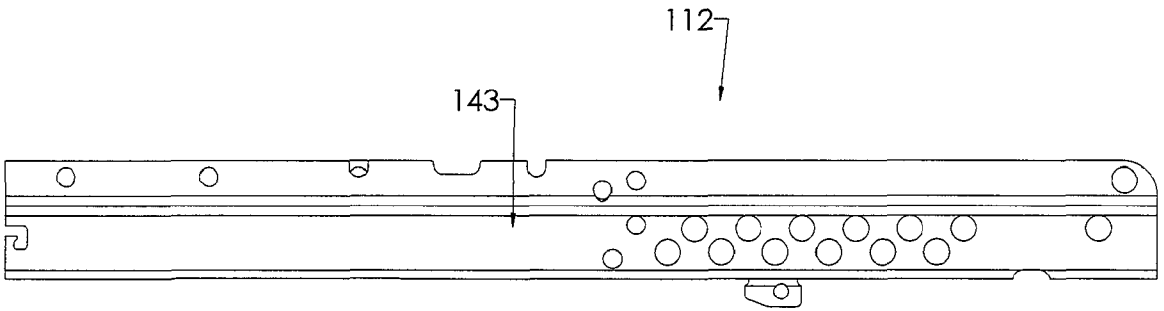

FIG. 15 is a side elevational view of a non-firing M249 housing body in accordance with this invention;

DETAILED DESCRIPTION OF ILLUSTRATIVE EMBODIMENTS

The non-firing housing taught herein is based specifically on a standard functioning receiver for the M249 Light Machine Gun, Caliber 5.56×45 mm. The functioning M249 receiver has a well known specific configuration for the barrel support, the bolt rails, and the receiver body. The non-firing M249 housing of this invention serves to imitate the standard functioning receiver, though it will not fire, particularly with standard M249 parts, and cannot readily be converted to fire.

The non-firing M249 housing in accordance with this invention is necessarily based upon the standard functioning M249 receiver that it is to imitate, and the terms "standard" and "non-firing" are employed to distinguish between the two. The "standard" receivers require specific firing components, guide components and feed mechanisms in order to function properly, and these various components are also referenced herein by employing the term "standard" to modify them. Thus, a standard (functioning) receiver includes standard firing components, standard guide components and standard feed mechanism components. The non-firing housing imitates the standard receiver, but is non-firing as a result of being configured to prohibit the receipt or functioning of at least one of the standard firing components, standard guide components or standard feed mechanism components. The guide components and other components of the non-firing housing that are altered to differ from related components of the standard M249 receiver are herein referred to using the term "non-firing" to modify them.

In accordance with this invention, comparison is made between elements of a standard receiver for a standard M249 and corresponding elements of a non-firing M249 housing, which is intended to imitate the standard M249 receiver and communicate with additional machine gun elements, such as a barrel, a trigger assembly, and a buttstock, as well as accessories, such as machine gun mounts, substantially as does the standard M249 receiver.

Figure 1:
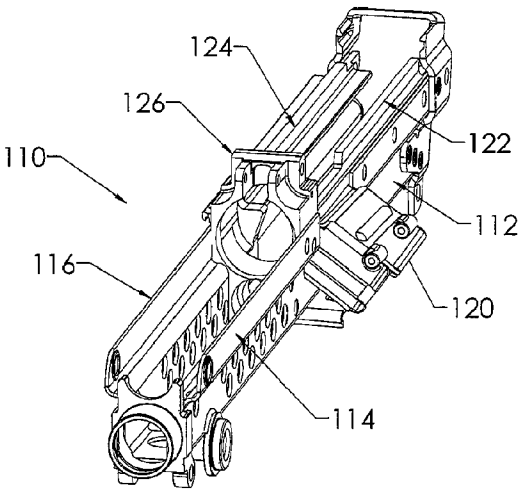
FIG. 1 is a perspective view of a non-firing M249 housing with the barrel support, left bolt rail, right bolt rail and magazine sleeve.

With reference to FIG. 1, the non-firing housing is shown and designated by the numeral 110. The non-firing housing 110 includes a non-firing housing body 112 including a left-hand sidewall 114 and right-hand sidewall 116. As with a standard receiver, this non-firing housing 110 is preferably stamped out of a flat sheet of metal so as to be a unitary and strong piece. The non-firing housing 110 defines a cavity 118 that houses firing components and receives a cover (not shown). A magazine sleeve 120 communicates with the cavity 118, substantially as in a standard receiver. The cavity 118 also receives non-firing guide components, including particularly a non-firing left bolt rail 122, a non-firing right bolt rail 124, and a non-firing barrel support 126. The non-firing guide components serve to support and guide the motion of fire-simulating components that will be placed in the non-firing housing to provide the non-firing M249 with means to simulate the action of a standard M249. In one or more embodiments, the non-firing M249 housing receives a standard M249 operating rod (or "op-rod") that communicates with a cocking lever as is standard practice in an M249. In one or more other embodiments, the fire-simulating components may include particularly a fire-simulating op-rod, a fire-simulating bolt link, and a fire-simulating bolt.

Figure 3:
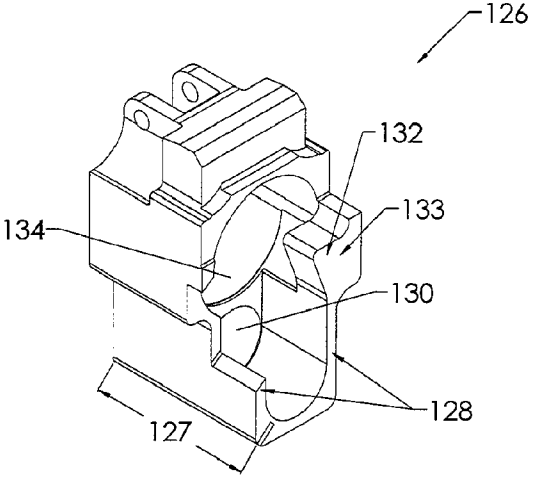
FIG. 3 is a perspective view of a non-firing M249 barrel support in accordance with this invention.
Figure 2:
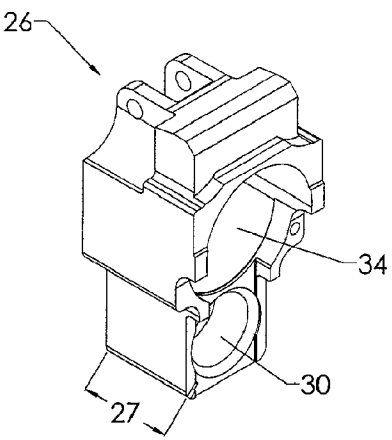
FIG. 2 is a perspective view of a standard barrel support for a standard M249 machine gun.

In one or more embodiments, the barrel support (or trunnion) in the non-firing M249 housing 110 is modified to prevent the standard M249 op-rod from properly reciprocating in the housing. A standard barrel support 26 for a standard M249 is shown in FIG. 2 for comparison with the non-firing barrel support 126 shown in FIG. 3. The non-firing barrel support 126 is manufactured with additional material prior to installation, and is designed to both limit forward travel of a fire-simulating op-rod and to prevent any bolt head from entering the locking region of the barrel that would be secured to the non-firing barrel support 126. Particularly, the axial length 127 of the bottom portion of the non-firing barrel support 126 is increased (as compared to the axial length 27 of a standard barrel support 26) by a rod-blocking extension 128 proximate the gas cylinder mount aperture 130.In the standard barrel support 26, the standard op-rod reciprocates at a similar gas cylinder mount aperture 30. Thus, attempted use of a standard M249 operating rod in the non-firing housing 110 will not allow live fire, at least because the rod-blocking extension 128, in cavity 118, will prevent the standard op-rod from travelling as necessary, i.e., as it would in a standard M249.

In one or more embodiments, the standard M249 barrel support is modified to prevent the standard M249 bolt head from entering the battery position in the non-firing housing 110. In a standard M249 barrel support 26, a standard M249 bolt head passes through the barrel aperture 34 to enter the battery position. In a modified barrel support 126 in accordance with this invention, a bolt-blocking wall 132 extends into the path of the barrel aperture 134, such that no bolt head, standard M249 or otherwise, would be able to enter the battery position, and, thus, a standard M249 bolt head would not function properly in a non-firing housing modified with the non-firing barrel support 126. In the particular embodiment shown, the rod-blocking extension 128 is formed as a contiguous piece with the bolt-blocking wall 132, but it will be appreciated that these structures could be made non-contiguous as well. This non-firing barrel support 126 is, in particular embodiments, welded into the non-firing housing body 112.

In some embodiments, the rod-blocking extension 128 of the barrel support 126 extends to a distance of from about 8 to 30 mm in length (axially) beyond the standard thickness of a standard M249 barrel support 26, as shown at 27 in FIG. 2. In other embodiments, the rod-blocking extension 128 extends approximately 8 to 25 mm beyond the standard thickness, and in yet other embodiments 10 to 20 mm beyond the standard. In a specific embodiment, the rod-blocking extension 128 extends 10 mm beyond the standard thickness of the standard barrel support, the standard axial length 27 being 37.5 mm, and the altered axial length 127 being 47.5 mm.

In some embodiments, the standard barrel support is altered by the addition of a bolt-blocking wall 132 extending into the path defined by the barrel aperture 134 at a distance of from 8 to 15 mm. In some embodiments, this bolt-blocking wall 132 extends off of the rod-blocking extension 128 and is integral therewith and provides a flat face 133. In some embodiments, the bolt-blocking wall 132 is generally triangular and extends to a point proximate the center of the barrel aperture 134.

Figure 6:
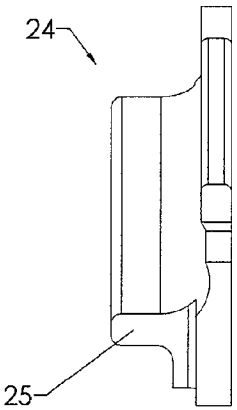
PRIOR ART FIG. 6
FIG. 6 is a rear perspective view of a standard right bolt rail for a standard M249 machine gun.
Figure 7:
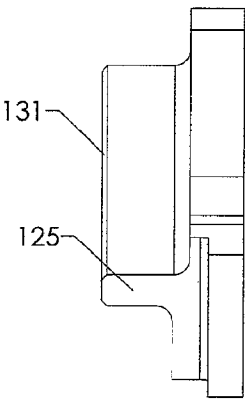
FIG. 7 is a rear perspective view of a right bolt rail for the non-firing
Figure 4:
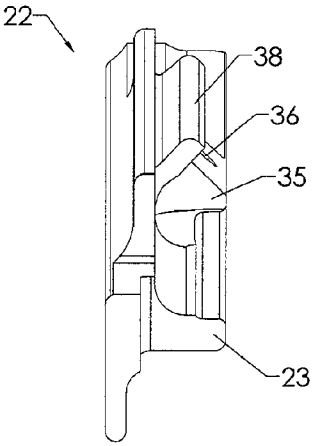
PRIOR ART FIG. 4
FIG. 4 is a rear perspective view of a standard left bolt rail for a standard M249 machine gun.
Figure 5:
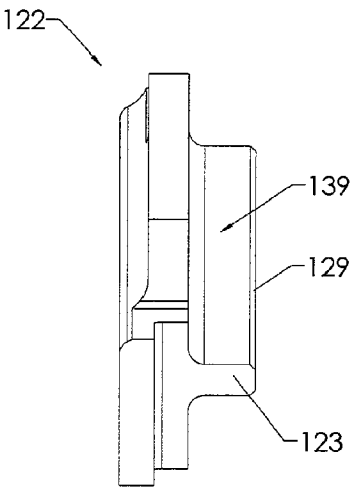
FIG. 5 is a rear perspective view of a left bolt rail for the non-firing M249 non-firearm of this invention.

A standard left bolt rail 22 for a standard M249 is shown in FIG. 4 for comparison with the non-firing left bolt rail 122 shown in FIG. 5. Similarly, a standard right bolt rail 24 for a standard M249 is shown in FIG. 6 for comparison with the non-firing right bolt rail 124 shown in FIG. 7. In the non-firing left bolt rail 122, the horizontal distance that the bolt rail protrudes into the housing 110 is increased as compared to distance that the standard left bolt rail 22 extend in the standard M249 receiver, and, in the non-firing right bolt rail 124, the horizontal distance that the bolt rail protrudes into the housing 110 is increased as compared to the distance that the standard right bolt rail 24 extends in the standard M249 receiver. This will serve to decrease the distance between the innermost ends of the bolt rails in the non-firing housing body 112, creating interference so that a standard M249 bolt head and bolt carrier will not fit in the non-firing housing body 112.Generally, the design of the non-firing left bolt rail 122 differs from the standard left bolt rail 22 by having a horizontal extension 123 that is increased in width. In a particular embodiment, the width is increased by approximately 1.5 mm as compared to the width of the standard horizontal extension 23. Similarly, the non-firing right bolt rail 124 differs from the standard right bolt rail 24 by having a horizontal extension 125 that is increased in width. In a particular embodiment, the width is increased by approximately 2 mm as compared to the width of the standard horizontal extension 25.

It will also be appreciated from FIGS. 4-7 that the general dimensions of the vertical and horizontal extensions that make up the non-firing left and right bolt rails 122, 124 are shaped quite differently than the corresponding vertical and horizontal extensions of the standard left and right bolt rails 22, 24. Particularly, vertical portions are much more blocky, with less rounded edges in the non-firing left and right bolt rails 122, 124. Additionally, the horizontal extensions 123 and 125 have beveled surfaces 129, 131 at their distal ends, whereas the standard extensions 23, 25 are rounded at their distal ends. In the non-firing right bolt rail 124, the vertical extension above the horizontal extension 125 is devoid of the concavity 33 provided in the vertical extension of the standard right side bolt rail 25. Other non-firing bolt rail distinctions will be disclosed herein.

In one or more embodiments, the design of a standard M249 receiver is further altered to provide the non-firing housing 110 by altering the location of the horizontal extension 125 of the non-firing right bolt rail 124 relative to the horizontal extension 123 of the non-firing left bolt rail 122 (or relative to the horizontal extension 23 of a standard left bolt rail 22, if the standard left bolt rail 22 is chosen not to be altered). As seen in comparison of FIGS. 8 (showing a standard M249 receiver 10) and 9 (showing the non-firing housing 110), the location of the non-firing right bolt-rail 124 is shifted upward as compared to the standard positioning of the standard right bolt rail 24. This prevents a standard M249 bolt head and bolt carrier from being inserted and employed in the non-firing housing 110. In a particular embodiment, the non-firing right bolt rail 124 is shifted up approximately 3 mm (as compared to the standard right bolt rail 24) so that the horizontal extension 125 is coincident with the horizontal extension 123, which is positioned as in a standard M249 (if a standard left bolt rail 22 is employed, the horizontal extension 125 would be coincident with extension 23). As seen in FIG. 9, this positioning and the increase in the length of the horizontal extensions 123, 125 of the non-firing left bolt rail 122 and non-firing right bolt rail 124 alters the geometry and decreases the distance between the extensions, creating interference so that a standard M249 bolt head and bolt carrier will not fit in the non-firing housing 110. In embodiments where both the non-firing barrel support 126 and the non-firing right bolt rail 124 are employed, the length of the right bolt rail 124 is made accordingly shorter than that of a standard right bolt rail 24 in order to fit properly and securely with the added axial material at the rod-blocking extension 128 and bolt-blocking wall 132.

A standard left bolt rail 22 for a standard M249 is shown in FIG. 10 for comparison with the non-firing left bolt rail 122 shown in FIG. 11. Reference should also be made to FIGS. 4 and 5. In FIGS. 4 and 10 the standard left bolt rail 22 includes ejector backstop material 38 and an ejector pin bore 36 in an ejector bore profile 35. As known, an ejector (not shown) would be secured to the standard left bolt rail 22 by an ejector pin (not shown) secured into the ejector pin bore 36. The ejector can swivel on the pin, which defines an axis for the ejector, and a spring (not shown) also secured to the pin would bias a length of the ejector against the backstop material 38. As seen in FIG. 11, both the ejector bore profile 35 (and thus the bore 36) and the backstop material 38 are absent as at 139 in the non-firing left bolt rail 122. In this way, it will not be possible to install a standard ejector, spring and pin in the non-firing housing 110 containing the non-firing left bolt rail 122, and the non-firearm will jam if an attempt is made to modify it for live fire.

A standard right bolt rail 24 for a standard M249 is shown in FIG. 12 for comparison with the non-firing right bolt rail 124 shown in FIG. 13. The standard right bolt rail 24 includes a hinge bore 40 that is to receive a spring-biased hinge (not shown) that is associated with an ejection port cover (not shown) to keep the ejection port open. Particularly, the spring-biased hinge prevents the ejection port cover (not shown) from closing off the ejection port 44 (see FIG. 14) at rest. The ejection port cover must be purposefully closed over the ejection port, typically when it is desired to prevent dust and dirt from getting in the weapon. As seen at numeral 42, material is absent adjacent the hinge bore 40 to provide room for the hinge and ejection port cover. In the non-firing right bolt rail 124 of FIG. 13, the hinge bore 40 is removed and material added as at 141 to provide a continuous profile without absent material as at 42 in the standard right bolt rail 24. This alteration further complicates any attempted conversion of the non-firing housing 110 to act as a standard functioning receiver.

In particular embodiments, the non-firing left bolt rail 122 and the non-firing right bolt rail 124 are welded to the housing 110.

A standard receiver body 12 for a standard M249 is shown in FIG. 14 for comparison with a non-firing housing body 112 shown in FIG. 15 for a non-firing M249 in accordance with this invention. The standard receiver body 12 includes an ejection port 44 through which spent cartridges are ejected, while the non-firing housing body 112 includes no such port, instead being whole at the typical ejection port location, as at 143. This further prohibits alteration of the non-firing housing 110 for use as part of a functioning firearm.

The present invention resides in the implementation of one or more of the forgoing design alterations. Such alterations will typically be made by designing new parts, as opposed to actually modifying existing standard M249 components. With one or more of the forgoing alterations, as shown in comparing standard M249 components with non-firing M249 components in accordance with this invention, a non-firing housing can be provided to imitate the standard functioning M249 receiver. The non-firing housing is non-firing as a result of being configured to prohibit the receipt or functioning of at least one of the standard firing components, standard guide components, standard feed components or standard ejection components. Though the non-firing housing 110 shown here includes multiple features for prohibiting standard guide components, standard firing components, standard feed components and standard ejection components, the invention herein should be appreciated as being directed to prohibiting the receipt of any or all of such components. That is, the various modifications may be employed in any number and combination in accordance with this invention, though various government laws and regulations may require the implementation of specific modifications to have the modified housing classified as a non firearm.

As known, the forward and backward movement of the op rod of a functioning M249 cycles internal components, commonly referred to as the action. The op-rod, bolt carrier and bolt head are all linked together and move forward and rearward in unison. The op-rod, bolt-carrier and bolt head are locked in the rearward position until the trigger is pulled. When the trigger is pulled, the op-rod, bolt-carrier and bolt head move forward in unison (under spring pressure). The bolt head strips a round of ammunition out of the belt or magazine, advancing it through the barrel extension and into the chamber. When the bolt head enters the barrel extension, it moves until the cartridge is seated in the barrel. Meanwhile, the bolt carrier and op-rod continue to move forward, forcing the bolt-head to perform a rotation and become locked in the barrel extension due to the angular track in the bolt carrier in which the bolt head rides. The firing pin in the bolt carrier impacts the primer on the round of ammunition, causing it to fire. When the cartridge fires, the bullet moves down the barrel, and the expanding gasses from the firing of the round vent into the gas cylinder to push on the op-rod and force it to the rear of the receiver. While the op-rod withdraws, it pulls on the bolt carrier. This causes the bolt head to rotate back to its original position, allowing it to become unlocked and the three components withdraw in unison. The ejector ejects the spent cartridge case, and the gun will continue to repeat the above operation until the trigger is released or ammunition is expended.

To further imitate a functioning machine gun, the non-firing housing 110 can optionally accept a standard M249 op-rod and associated cocking lever to allow an individual to cock the non-firing M249 and better simulate the feeling of holding and cocking such a rifle. In other embodiments, the non-firing M249 can include additional non-functional fire-simulating components as opposed to the standard firing components that function properly in a standard M249. For example, op-rod, spring and bolt components may be incorporated to simulate the cycling of similar components in a standard M249. Due to the alterations made to the dimensions and positioning of the barrel support and bolt rails in the non-firing housing 110, a fire-simulating bolt head and a fire-simulating bolt carrier could be fabricated and incorporated so as to be unique to the non-firing M249 and fit therein and stabilize the operating rod to give it the ability to cycle for simulation and training. Nevertheless, the M249 is non-firing and is not capable of being reverse engineered back to a functioning (firing) state.

Notably, the non-firing housings made in accordance with this invention can be made to appear at the exterior as exact replicas of the functioning receivers they are intended to imitate. Additionally, the non-firing housings can be made to accept the barrels, stocks and lowers that the functioning receivers accept, such that the non-firing housings can receive these components and thus provide a non-firing imitation of a machine gun that, at the exterior, looks identical to the machine gun it is intended to imitate. Indeed, this is preferred in many instances. For example, mount dealers will benefit from being able to mount and show a non-firing imitation of a machine gun that exactly replicates the exterior of a functioning machine gun, and yet will not have to address the laws and regulations and down time associated with the various forms and procedures that must be followed to take possession of and mount and show a functioning machine gun. Non-firing guns providing a replica of the exterior surface of a functioning gun will also be useful for training purposes.

Based upon the foregoing disclosure, it should now be apparent that the present invention provides advances in the art by providing non-firing M249 housings that imitate functioning M249 receivers. The present invention also advances the art by providing means for altering functioning M249 receivers to be non-firing housings.

The invention claimed is:

1. A non-firing housing imitating a functioning receiver for an M249 machine gun, the non-firing housing including:

a non-firing housing body; and a non-firing barrel support secured to said non-firing housing body, said non-firing barrel support being dimensioned differently from the standard M249 barrel support so as to prevent receipt and proper functioning of one or more of a standard M249 bolt head and a standard M249 op-rod, wherein said non-firing barrel support has an extended axial length that is greater than the axial length of a standard M249 barrel support such that the non-firing housing prohibits the receipt and proper reciprocation of a standard M249 op-rod.

2. A non-firing housing imitating a functioning receiver for an M249 machine gun, the non-firing housing including:

a non-firing housing body; and a non-firing barrel support secured to said non-firing housing body, wherein said non-firing barrel support provides a bolt-blocking wall that prevents a standard M249 bolt head from entering the battery position.

3. The non-firing housing of claim 2, wherein said non-firing barrel support defines a barrel aperture and said bolt-blocking wall extends into the path of said barrel aperture.

4. A non-firing housing imitating a functioning receiver for an M249 machine gun, the non-firing housing including:

a non-firing housing body; and a non-firing barrel support secured to said non-firing housing body, wherein said non-firing barrel support has an extended axial length that is greater than the axial length of a standard M249 barrel support such that the non-firing housing prohibits the receipt and proper reciprocation of a standard M249 op-rod.

5. The non-firing housing of claim 4, wherein said extended axial length is from 8 to 30 millimeters (mm).

6. The non-firing housing of claim 4, further comprising a non-firing bolt rail dimensioned to mate with said extended axial length of said non-firing barrel support, said non-firing bolt rail being dimensioned differently than a standard M249 bolt rail.

7. The non-firing housing of claim 6, wherein said non-firing bolt rail is a non-firing right bolt rail and includes a horizontal extension that extends at a higher position relative to the non-firing housing body than does the horizontal extension of a standard M249 right bolt rail relative to a standard M249 housing body.

8. A non-firing housing imitating a functioning receiver for an M249 machine gun, the non-firing housing including:

a non-firing housing body; and a non-firing bolt rail selected from a non-firing right bolt rail and a non-firing left bolt rail, said non-firing bolt rail being secured to said non-firing housing body, wherein said non-firing bolt rail includes a horizontal extension that, in the case where said non-firing bolt rail is selected to be a non-firing right bolt rail, extends further into said non-firing housing body than does the horizontal extension of a standard M249 right bolt rail relative to a standard M249 housing body, and, in the case where said non-firing bolt rail is selected to be a non-firing left bolt rail, extends further into said non-firing housing body than does the horizontal extension of a standard M249 left bolt rail relative to a standard M249 housing body.

9. The non-firing housing of claim 8, wherein the non-firing bolt rail prevents the non-firing housing from receiving a standard M249 bolt head and bolt carrier.

10. The non-firing housing of claim 9, wherein said non-firing bolt rail is a non-firing right bolt rail.

11. The non-firing housing of claim 10, further comprising a non-firing left bolt rail secured to said non-firing housing body, wherein said non-firing left bolt rail includes a horizontal extension that extends further into said non-firing housing body than does the horizontal extension of a standard M249 left bolt rail in a standard M249 housing body.

12. The non-firing housing of claim 11, wherein said non-firing right bolt rail includes a horizontal extension that extends at a higher position relative to the non-firing housing body than does the horizontal extension of a standard M249 right bolt rail relative to a standard M249 housing body.

13. A non-firing housing imitating a functioning receiver for an M249 machine gun, the non-firing housing including:

a non-firing housing body; and a non-firing right bolt rail secured to said non-firing housing body, wherein said non-firing right bolt rail includes a horizontal extension that extends at a higher position relative to the non-firing housing body than does the horizontal extension of a standard M249 right bolt rail relative to a standard M249 housing body.

14. A non-firing housing imitating a functioning receiver for an M249 machine gun, the non-firing housing including:

a non-firing housing body; and a non-firing left bolt rail that is devoid of an ejector pin bore and devoid of backstop material, both of which are existent in a standard M249 machine gun for the installation of an ejector, such that the absence thereof in the non-firing housing prohibits the installation of an ejector.

15. A non-firing housing imitating a functioning receiver for an M249 machine gun, the non-firing housing including:

a non-firing housing body that mimics the appearance of a standard M249 machine gun and is devoid of an ejection port, the existence of which is necessary in a standard M249 machine gun; and a non-firing barrel support secured to said non-firing housing body, said non-firing barrel support being dimensioned differently from the standard M249 barrel support so as to prevent a standard M249 bolt head from entering the battery position;

a non-firing right bolt rail secured to said non-firing housing body, wherein said non-firing right bolt rail includes a horizontal extension that extends at a higher position relative to the non-firing housing body than does the horizontal extension of a standard M249 right bolt rail relative to a standard M249 housing body, said non-firing right bolt rail being devoid of a hinge bore, the existence of which is necessary in a standard M249 machine gun in order to receive the hinge for an ejection port cover; and a non-firing left bolt rail that is devoid of an ejector pin bore and devoid of backstop material, both of which are existent in a standard M249 machine gun for the installation of an ejector, such that the absence thereof in the non-firing housing prohibits the installation of an ejector, wherein at least one of said non-firing right bolt rail and said non-firing left bolt rail includes a horizontal extension that extends further into said non-firing housing body than does the horizontal extension of a standard M249 right bolt rail or standard M249 left bolt rail relative to a standard M249 housing body.

* * * * *